US006702433B2

(12) United States Patent
Kono

(10) Patent No.: US 6,702,433 B2
(45) Date of Patent: Mar. 9, 2004

(54) INK SUPPLY MECHANISM AND INK JET RECORDING APPARATUS

(75) Inventor: Takeshi Kono, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,801

(22) Filed: Jan. 30, 2002

(65) Prior Publication Data

US 2002/0109758 A1 Aug. 15, 2002

(30) Foreign Application Priority Data

Feb. 9, 2001 (JP) ..... 2001-033777

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | |
|---|---|---|---|---|
| 4,419,678 A | | 12/1983 | Kasugayama et al. | 346/140 R |
| 5,485,187 A | | 1/1996 | Okamura et al. | 347/85 |
| 5,801,736 A | | 9/1998 | Ikkatai et al. | 347/86 |
| 6,234,615 B1 | * | 5/2001 | Tsukuda | 347/85 |
| 6,283,585 B1 | | 9/2001 | Ikkatai et al. | 347/85 |
| 2002/0109761 A1 | | 8/2002 | Shimizu et al. | 347/86 |
| 2002/0122103 A1 | | 9/2002 | Yamamoto et al. | 347/85 |

FOREIGN PATENT DOCUMENTS

| | | | | |
|---|---|---|---|---|
| EP | 803364 | | 10/1997 | |
| EP | 1080914 | | 3/2001 | |
| JP | 405096744 | * | 4/1993 | 347/86 |
| JP | 2929804 | | 5/1999 | |
| JP | 2001-71522 | | 3/2001 | |

OTHER PUBLICATIONS

U.S. application No. 10/066,623, filed Feb. 6, 2002.

* cited by examiner

*Primary Examiner*—Anh T.N. Vo
(74) *Attorney, Agent, or Firm*—Fitzpatrick, Cella, Harper & Scinto

(57) ABSTRACT

An ink supply mechanism comprises an ink supply tube for supplying ink to a recording head, an ink supply needle communicated with a liquid flow path, and an air inducing needle communicated with an atmospheric communication port. The ink supply needle and the air inducing needle are communicated with the inside of a main tank by being penetrated through rubber plugs provided for the bottom of the main tank, respectively, to enable liquid paths to be communicated through the main tank. Also, both the ink supply needle and the air inducing needle are formed by conductive material, and a circuit is connected therewith to measure the electrical resistance of ink. The flow path is communicated with the atmospheric communication port by way of a portion positioned higher than the upper opening of the air inducing needle. With the structure thus arranged, the ink supply mechanism prevents ink from leaking from the atmospheric communication port.

6 Claims, 5 Drawing Sheets

INK SUPPLY MECHANISM AND INK JET RECORDING APPARATUS

BACKGROUND OF THE INVENTION

1. Field of the Invention

The present invention relates to an ink supply mechanism for supplying ink to an ink jet head, and also, relates to an ink jet recording apparatus.

2. Related Background Art

Of the recording methods for a printer or the like, the ink jet recording method that records on a recording medium, such as a recording paper sheet, by discharging ink from the discharge ports (nozzles) has been widely adopted in recent years, because it performs recording operation at high speed in high density by use of the low-noise non-impact recording method.

In general, an ink jet recording apparatus comprises means for driving a carrier that mounts an ink jet head thereon; conveyance means for conveying a recording paper sheet; and control means for controlling them, among some others. Also, there is the one which uses electromechanical converting elements, such as piezoelectric elements, to exert pressure on ink in order to generate energy for discharging ink from the nozzle portion of an ink jet heat; irradiates electromagnetic waves, such as laser, to generate heat; generates heat for bubbling; or uses electrothermal converting elements each having heat resistive element for heating liquid for bubbling. Among them, the ink jet recording apparatus that adopts the method for discharging ink droplets utilizing thermal energy makes it possible to perform recording in high resolution with the nozzles that can be arranged in high density. Particularly, the ink jet head that uses electrothermal converting elements as energy generating elements can be made smaller with ease, and by the application of the IC technologies and micro-machining techniques, which have made remarkable technical advancement and enhancement of reliability in the field of semiconductor manufacturing in recent years, the ink jet head of the kind can be assembled in high density at lower costs utilizing the advantages of these technologies and techniques sufficiently.

Now, FIG. 5 shows one example of the conventional ink jet recording apparatus that adopts the method of discharging ink droplets utilizing thermal energy, in which the discharge nozzle 101*g* of a recording head 101 is a fine hole. There is no particular valve mechanism provided for the nozzle. With the interior of the nozzle being kept in negative pressure, the nozzle enables ink to be given meniscus to prevent ink leakage from the nozzle, as well as to prevent the air from entering the nozzle from the atmosphere. Ink is discharged by pushing out ink in the discharge nozzle 101*g* by means of film-boiling energy of the heater arranged in the vicinity of the discharge nozzle 101*g*. After discharge, ink is filled again in the nozzle by means of capillary force of the discharge nozzle 101*g*. This cycle is repeated, and ink is absorbed from the main tank 104 through a tube 106 as required.

In the recording head 101, there are arranged a filter 101*c* having a fine mesh structure to prevent the discharge nozzle 101*g*, which is a fine hole, from being clogged by dust particles; the flow path 101*f* that connects the filter 101*c* and the discharge nozzle 101*g*; and the sub-tank 101*b* for retaining ink in a given amount, which is arranged on the upstream side of the filter 101*c*, here, ink being supplied thereto by way of the tube 106 from the main tank 104 installed on the main body of the ink jet recording apparatus.

The main tank 104 and the supply base 105 are structured as disclosed in the specification of Japanese Patent Publication 2929804, and the liquid connector 104*b* on the bottom face of the main tank 104 is detachably installed on two hollow needles 105*a* and 105*b* fixed to the supply base 105.

In the supply base 105, there is arranged the ink chamber 105*f* which is released to the atmosphere by means of an atmospheric port 105*g*. The hollow needles 105*a* and 105*b* are arranged in such a manner that the height of the low end of the hollow needle 105*b* is made different from that of the hollow needle 105*a* so as to keep it in ink in the ink chamber 105*f*. The ink chamber 105*f* is structured to be communicated with the tube 106 from the bottom portion of the ink chamber 105*f*. Then, when the lower end of the hollow needle 105*b* appears on the liquid surface of the ink chamber 105*f* as the liquid surface of the ink chamber 105*f* is lowered following the reduction of ink in the ink chamber 105*f* due to ink consumption, the air enters the interior of the main tank 104 from the lower end of the hollow needle 105*b*. Thus, ink in the main tank 104 flows out to the ink chamber 105*f* to raise the liquid surface of ink in the ink chamber 105*f* to cause the lower end of the hollow needle 105*b* to be immersed again in ink. With the structure thus formed, ink in the main tank 104 is drawn out gradually.

Also, on the lower part of the main tank 104, the electrode 104*e* is arranged to be in contact with ink, which is in conduction with the contact point 105*j* provided for the supply base 105. To the contact point 105*j* and the hollow needle 105*b*, the detection circuit 105*h*, which measures the electric resistance of ink, is connected to detect the presence and absence of ink.

In the sub-tank 101*b*, the air that permeates the resin material of the tube 106 or the like to enter the sub-tank, and the air dissolved and retained in ink is accumulated as well. Therefore, the accumulated excessive air is sucked out together with ink periodically from the side wall of the sub-tank 101*b* by means of the exhaust tube 110*a* and the exhaust pump 110*c*. Then, the sub-tank is closed by the valve 110*b* when the exhaust is completed to maintain the ink discharge characteristics.

Also, if overly viscous ink causes the discharge nozzle 101*g* to be clogged or any excessive bubble that may be generated at the time of discharge ensues in clogging, the recovery of ink discharge characteristics is made by sucking ink intensively from the discharge nozzle 101*g* by means of the suction pump provided for the suction cap 107*a* of the recovery unit 107.

Now, however, even if a step is taken to deal with any unexpected movement of ink (such as ink being returned from the head side to the ink chamber 105*f*) with the provision of a mechanism, which is additionally provided for the ink supply mechanism of the conventional structure exemplified as described above, to close the tube 106 on the midway when operation is at rest, there is still a possibility that ink flows out externally from the atmospheric communication port 105*g* if the apparatus shown in FIG. 5 is inclined to make its right side higher, for example, due to the occurrence of unusual situation under which the apparatus shown in FIG. 5 moves to change its installation site.

Further, when the ink liquid surface of the ink chamber 105*f* is caused to part from the end portion of the hollow needle 105*b*, the leading end of the hollow needle 105*b* is released to the atmosphere. In this state, the air is induced from the hollow needle 105*b* into the main tank 104, and ink in the main ink tank 104 flows out to the ink chamber 105*f* along with the induction of the air. Thus, unless the leading end portion of the hollow needle 105*b* is clogged by ink, ink in the main tank 104 flows out continuously, and in the worst case, there may occur the event that all ink in the main tank 104 flows out into the ink chamber 105*f*. The ink chamber 105*f* is not capable enough to receive all ink in the main tank 104. As a result, ink that flows out from the ink chamber 105*f* is allowed to flow out externally from the atmospheric communication port 105*g* eventually. In addition, if the volume of the ink chamber 105*f* is made large enough to receive all ink in the main tank 104, the structure of the apparatus becomes extremely large, which is not practicable.

Meanwhile, it is an important technique to detect ink remainders in an ink jet recording apparatus in order to protect the head or avoid wasting an object to print on eventually. For example, the structure shown in FIG. 5, in which electrodes are buried in the main tank for purpose of detecting ink remainders, needs the provision of electrodes and more parts at the connecting point therebetween, thus resulting in the increased costs of the apparatus and the main tank inevitably.

Here, for example, the hollow needles 105*a* and 105*b* are connected to the detection circuit to form a structure whereby to detect the resistance of ink residing between the two hollow needles in the main tank 104. With this structure, however, the resistance of ink is detected as far as ink exists in the ink chamber 105*f* even when there is no ink in the main tank 104, and the result of detection may sometimes indicate the presence of ink in the main tank 104, because the hollow needles 105*a* and 105*b* are in contact through ink in the ink chamber 105*f*. Also, even when the main tank 104 is removed, the detection is effectuated to indicate the presence of ink if ink remains in the ink chamber 105*f*. As a result, irrespective of the presence or absence of the main tank 104, detection indicates that ink is in the normal status, leading to a drawback that the installation status of main tank is not detectable.

SUMMARY OF THE INVENTION

With a view to solving the problems discussed above, the present invention is designed to aim at the provision of the ink supply mechanism capable of maintaining the ink supply status stably without being affected by the status (conditions in movement and installation site) of the ink jet recording apparatus that uses such mechanism, as well as the provision of an ink jet recording apparatus.

It is another object of the invention to provide an ink supply mechanism structured to make it difficult for ink in the main tank to leak from the atmospheric communication port, and an ink jet recording apparatus as well.

It is still another object of the invention to provide an ink supply mechanism capable of detecting the presence and absence of ink in the main tank, as well as detecting with ease the state of the main tank being mounted or unmounted, and also to provide an ink jet recording apparatus.

In order to achieve the objects described above, the ink supply mechanism of the present invention for an ink supply device that supplies ink from an ink tank to a recording head comprises an ink tank freely attachable and detachable, which retains ink therein with two connectors provided for the bottom thereof for enabling the inside thereof to be communicated with the outside. For this ink supply mechanism, a first hollow needle, which is communicated with the ink supply path for supplying ink to the recording head, is inserted into one of the connectors for communication, and a second hollow needle, which is communicated with the bottom of the atmospheric communication chamber communicated with the atmosphere through an atmospheric communication port, is inserted into the other one of the connectors for communication in order to form one flow path airtightly closed to the atmosphere from the atmospheric communication port to the ink supply path through the ink tank.

The ink supply device structured as described above enables the first hollow needle connected with the ink supply path and the second hollow needle communicated with the bottom end of the atmospheric communication chamber communicated with the atmosphere through the atmospheric communication port to be inserted into each of the connectors of the ink tank for communication, thus forming one flow path airtightly closed to the atmosphere from the atmospheric communication port to the ink supply path through the ink tank. In other words, with the formation of one airtightly closed flow path from the atmospheric communication port to the ink supply path, it becomes possible to eliminate the flow-in of the air on the midway of the flow path, and the ink leakage as well, and also, to block the movement of ink in the flow path.

Also, for the ink supply device of the present invention, the first hollow needle and the second hollow needle are formed by conductive material, and a circuit may be provided to measure the value of electric resistance between the first and second hollow needles. In this case, the ink that resides between the two hollow needles is only ink in the ink tank. As a result, there is no possibility that the resistance of any ink residing outside the ink tank is detected unexpectedly.

Further, the atmospheric communication chamber is a space expanded from the lower end of the second hollow needle upward, and the atmospheric communication port provided for the atmospheric communication chamber may be arranged at a position higher than the opening of the second hollow needle on the insertion side thereof into the connector for communication, and part of the path between the atmospheric communication port and the second hollow needle may be positioned to be higher than the opening of the second hollow needle on the insertion side thereof into the connector for communication. In this case, it becomes possible to prevent ink leakage from the atmospheric communication port even if the ink tank is mounted erroneously without the installation of the recording head, for example. Also, with the structure of the atmospheric communication chamber as a space expanding from the lower end of the second hollow needle upward, it becomes possible to enable ink in the atmospheric communication chamber to return to the main tank reliably even when the environmental condition is restored while ink has leaked into the atmospheric communication chamber due to the environmental changes or the like or even if ink is supplied while the recording is performed in a state of ink residing in the atmospheric communication chamber. In this way, there is no possibility that ink is consumed wastefully.

Also, the volume of the atmospheric communication chamber may be set to satisfy $Va > Vt \times (T_2 - T_1)/T_2$ where $T_1$ is the lower limit temperature of use environmental temperature; $T_2$ is the upper limit temperature of use environmental temperature; Va is the volume of the atmospheric communication chamber; and Vt is the volume of the ink tank. In this case, even if the temperature of the use environment is caused to change to push out ink due to the resultant changes of inner pressure of the ink tank, the atmospheric communication chamber has the volume good enough to function as a buffer chamber for the ink that has been pushed out, thus retaining ink thus pushed out to prevent ink leakage from the atmospheric communication port.

The ink supply mechanism of the present invention comprises an ink supply path for supplying ink to a recording head connected with an ink tank capable of being attached to and detached from a recording apparatus; and an atmospheric communication path connected with the ink tank to condition the ink tank to be communicated with the atmosphere. For this supply mechanism, the ink supply path and the atmospheric communication path are made communicative as one path through the ink tank only in the state of being connected with the ink tank, and the ink supply path and the atmospheric communication path are cut off when the ink tank is not mounted.

With the ink supply mechanism of the present invention thus structured, it becomes possible to make the ink supply path and the atmospheric communication path one communicative path through the ink tank. In other words, the passage between the atmospheric communication port and the ink supply path is made one flow path which is airtightly closed to eliminate the flow-in of the air from the midway of the flow path, and the ink leakage as well, while blocking the movement of ink in the flow path. Also, when ink is not mounted, the ink supply path and the atmospheric communication path is cut off to condition them to be independent from each other. For example, therefore, if only the electrical conduction across the ink supply path and the atmospheric communication path is examined, it becomes possible to determine whether or not the ink tank is mounted.

The ink jet recording apparatus of the present invention is provided with conveying means for conveying a recording medium to perform recording by discharging ink from a recording head to the recording medium, which comprises an ink supply mechanism of the present invention.

The ink jet recording apparatus of the invention structured as described above is provided with the ink supply device of the invention to make it possible to prevent ink leakage from the atmospheric communication port. Also, the presence and absence of ink in the ink tank can be grasped exactly. Whether or not the ink tank is mounted can be grasped, too.

DETAILED DESCRIPTION OF THE PREFERRED EMBODIMENTS

Now, with reference to the accompanying drawings, the detailed description will be made of the embodiments in accordance with the present invention.

Figure 1:
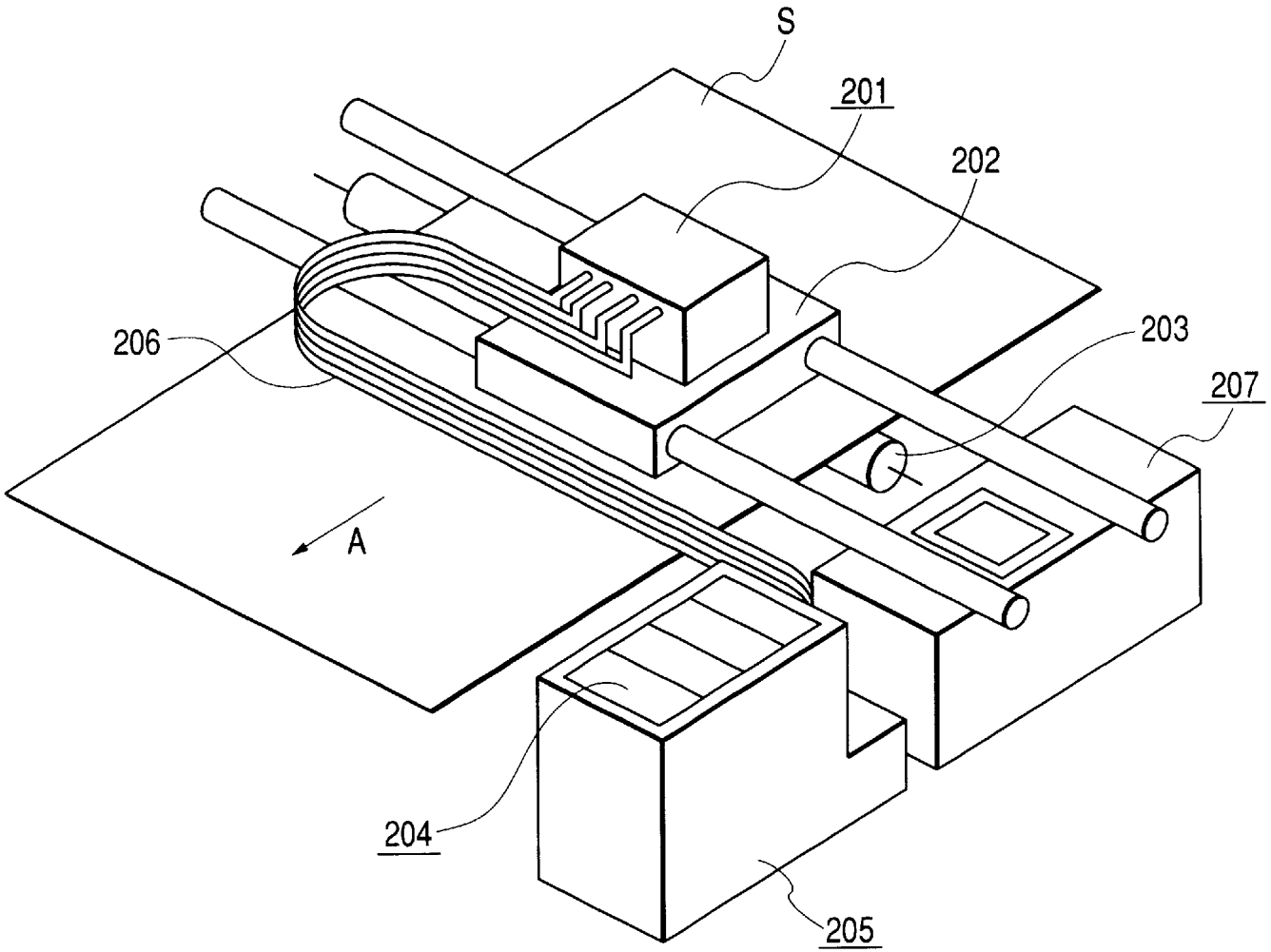
FIG. 1 is a perspective view that schematically shows the structure of an ink jet recording apparatus in accordance with one embodiment of the present invention.

FIG. 1 is a perspective view that schematically shows the structure of an ink jet recording apparatus in accordance with one embodiment of the present invention.

The ink jet recording apparatus shown in FIG. 1 is a serial type recording apparatus in which while the reciprocation (main scanning) of the recording head 201, and the conveyance (sub-scanning) of a general recording paper sheet, a special paper sheet, an OHP film, or other recording sheet S at a designated pitch are repeated, ink is selectively discharged from the recording head 201 in synchronism with such repeated movement to enable ink to adhere to the recording sheet S for the formation of characters, images, or the like.

In FIG. 1, the recording head 201 is detachably mounted on the carriage 202 slidably supported by two guide rails, which reciprocates along the guide rails by driving means such as a motor (not shown). The recording sheet S faces the ink discharge surface of the recording head 201 by means of the conveying roller 203. Then, it is conveyed in the direction intersecting with the traveling direction of the carriage 202 (the orthogonal direction indicated by an arrow A, for instance), while maintaining a distance with the ink discharge surface constantly.

The recording head 201 is provided with a plurality of nozzle arrays for discharging ink of different colors, respectively. For ink of different colors to be discharged from the recording head 201, individual main tanks 204 are detachably mounted on the ink supply unit 205. The ink supply unit 205 and the recording head 201 are connected by use of a plurality of ink supply tubes 206 in accordance with ink of different colors, respectively. Then, when the main tank 204 is mounted on the ink supply unit 205, it becomes possible to supply ink of each color retained in the main tank 204 to each of the nozzle arrays of the recording head 201 independently.

Within the reciprocation range of the recording head 201 but in the non-recordable area, which is out of the passing range of the recording sheet S, there is arranged the recovery unit 207 facing the ink discharge surface of the recording head 201.

Figure 2:
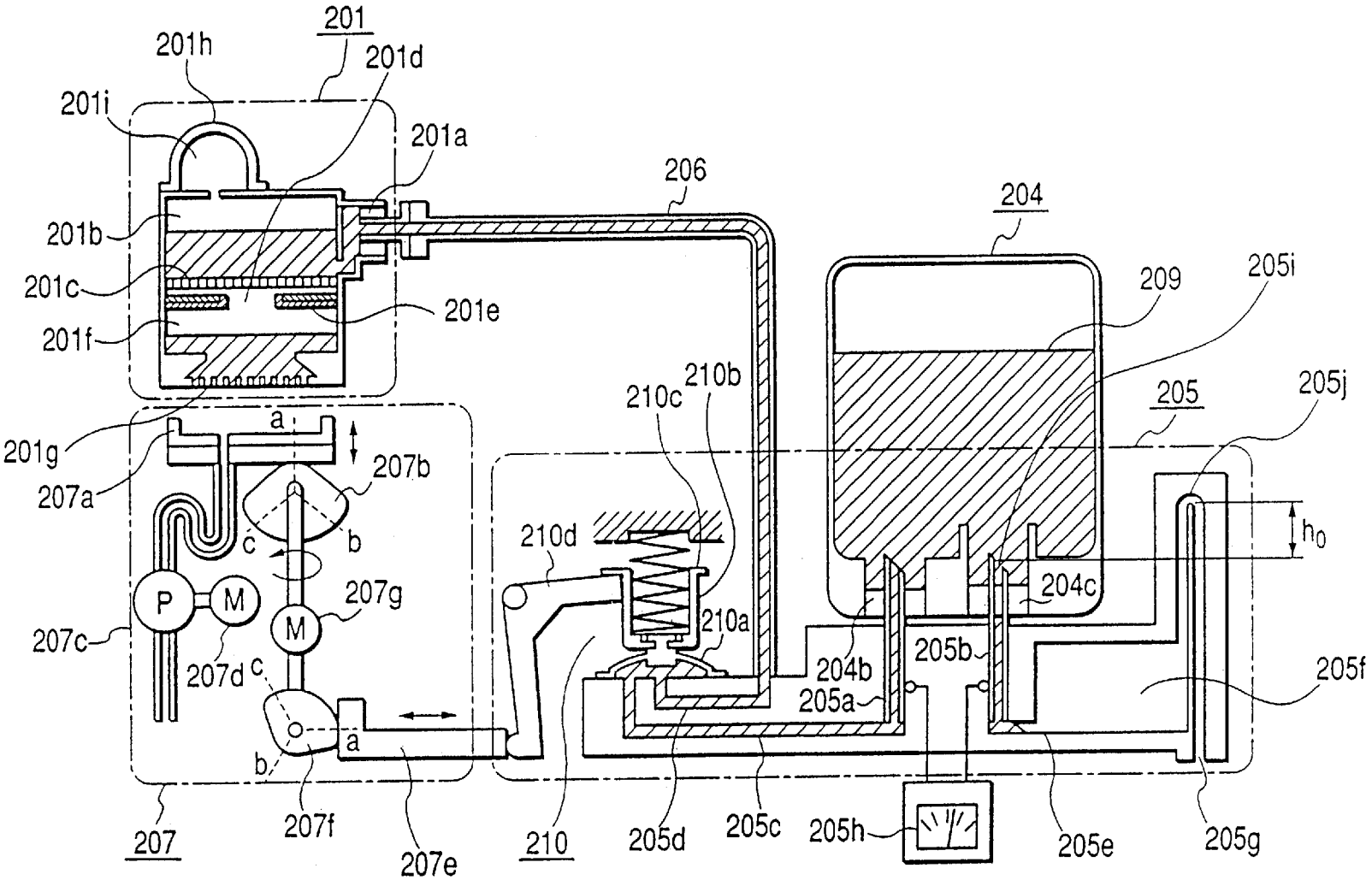
FIG. 2 is a view that illustrates the detailed structure of the ink supply system of an ink jet recording apparatus in accordance with one embodiment of the present invention.

Next, with reference to FIG. 2, the description will be made of the detailed structure of the ink supply system of the ink jet recording apparatus. FIG. 2 is a view illustrating the ink supply passage of the ink jet recording apparatus shown in FIG. 1. In order to simplify the description, only the path for one color portion is represented therein.

At first, the recording head 201 will be described.

To the recording head 201, ink is supplied from the connector insertion port 201*a* having a liquid connector airtightly connected therewith, which is arranged at the leading end of the ink supply tube 206. The connector insertion port 201*a* is communicated with the sub-tank 201*b* formed on the upper part of the recording head 201. Below the sub-tank 201*b*, the liquid chamber 201*f* is formed to supply ink directly to the nozzle unit provided with a plurality of nozzles 201*g* arranged in parallel. The sub-tank 201*b* and the liquid chamber 201*f* are partitioned by use of the filter 201*c*, but there is arranged a partition 201*e* having an opening 201*d* formed therefor on the boundary between the sub-tank 201*b* and the liquid chamber 201*f*. The filter 201*c* is installed on the partition 201*e*.

With the structure thus arranged, the ink, which is supplied from the connector insertion port 201*a* to the recording head 201, is supplied to the nozzle 201*g* through the sub-tank 201*b*, the filer 201*c*, and the liquid chamber 201*f*. The passage between the connector insertion port 201*a* and nozzle 201*g* is kept in a state of being airtight to the atmosphere.

On the upper face of the sub-tank 201*b*, an opening portion is formed. The opening portion is covered by a domed elastic material 201*h*. The space encircled by the elastic material 201*h* (a pressure adjustment chamber 201*i*) is capable of changing the volume thereof in accordance with the pressure in the sub-tank 201*b*, and functions to adjust the pressure in the sub-tank 201*b* to be described later.

The nozzle 201*g* is formed to be cylindrical having the sectional width of approximately 20 μm, and ink is discharged from the nozzle 201*g* when ink in the nozzle 201*g* is given discharge energy. Then, after ink is discharged, ink is filled in the nozzle 201*g* by means of the capillary force of the nozzle 201*g*. Usually, the discharge is repeated with cycle of 20 kHz or more so as to form images precisely at high speed. In order to give the discharge energy to ink in the nozzle 201*g*, the recording head 201 is provided with energy generating means per nozzle 201*g*. For the present embodiment, the heat generating resistive element is used as energy generating means for heating ink in the nozzle 201*g*, which is selectively driven by the instruction from the head controller (not shown) that controls the driving of the recording head 201, thus generating film boiling in ink in a desired nozzle 201*g*. The pressure of bubble generated in this manner is utilized for discharging ink from the nozzle 201*g*.

Each of the nozzles 201*g* is arranged with its ink discharging tip downward, but there is no valve mechanism arranged to close such tip. Ink is filled in the nozzle 201*g* in condition that it forms meniscus. As a result, the interior of the recording head 201, particularly inside the nozzle 201*g*, is kept in a state of being negatively pressurized. However, if the negative pressure is too small, the meniscus of ink is broken to cause ink to leak from the nozzle 201*g* should foreign substance or ink adhere to the discharging tip of the nozzle 201*g*. On the contrary, if the negative pressure is too large, the force that draws ink into the nozzle 201*g* becomes greater than the energy given to ink at the time of discharge, resulting in defective discharge. Therefore, the negative pressure in the nozzle 201*g* should preferably be within a range of approximately −0.4 kPa to approximately −2.0 kPa according to the results of experiments carried out by the inventors hereof (here, the specific gravity of ink is assumed to be that of water), although it differs depending on the setting number of nozzles 201*g*, the sectional area of each nozzle, and the performance of each heat generating resistive element, among some others.

In accordance with the present embodiment, the ink supply unit 205 and the recording head 201 are connected with the ink supply tube 206, and the recording head 201 can be positioned comparatively freely to the ink supply unit 205 to make it possible to arrange the recording head 201 at a position higher than the ink supply unit 205 for making the inner pressure of the recording head 201 negative. As regards this height, the description will be made further in detail.

The filter 201*c* is formed by the metal mesh having fine holes of less than 10 μm each, which is smaller than the sectional width of the nozzle 201*g*, in order to prevent any foreign substance that may clog the nozzle 201*g* from flowing out into the liquid chamber 201*f* from the sub-tank 201*b*. For the filter 201*c*, the meniscus of ink is formed in each fine hole by means of capillary force if ink is in contact with only one face of the filter 201*c*, thus presenting the property that makes ink to be transmitted with ease, but makes the flow of air difficult. The smaller the size of fine hole, the stronger is the intensity of meniscus to make it more difficult for the air to pass.

For the filter 201*c* used for the present embodiment, the pressure needed for the transmission of the air is approximately 10.1 kPa (experimental value), Therefore, if the air resides in the liquid chamber 201*f* positioned on the downstream of the filter 201*c* in the direction of ink movement in the recording head 201, the air cannot pass the filter 201*c* only by the floatation of the air itself or the like. As a result, the air in the liquid chamber 201*f* remains in the liquid chamber 201*f*. For the present embodiment, this phenomenon is utilized, and while the liquid chamber 201*f* is not filled with ink, a specific amount of ink is retained in the liquid chamber 201*f* so as to enable the air layer between ink in the liquid chamber 201*f* and the filter 201*c*.

The amount of ink that should be retained in the liquid chamber 201*f* is the minimum amount of ink required to fill in the nozzle 201*g*. If the air enters the nozzle 201*g* from the liquid chamber 201*f*, ink cannot be replenished in the nozzle 201*g* after ink has been discharged, and defective discharge may ensue. It is necessary, therefore, to fill the nozzle 201*g* with ink at all times.

With the upper face of the filter 201*c*, ink in the sub-tank 201*b* is in contact, and the area where ink is in contact is the effective area of the filter 201*c*. As described in conjunction with the conventional art, the pressure loss caused by the filter 201*c* depends on the effective area of the filer 201*c*. In accordance with the present embodiment, the filter 201*c* is arranged to be horizontal to the recording head 201 when it is in use so that ink is in contact with the entire upper face of the filter 201*c* to maximize the effective area of the filter for the reduction of the pressure loss.

The pressure adjustment chamber 201*i* is a chamber the volume of which is reduced as the negative pressure increases in it. It is preferable to use a rubber material or the like for the elastic member 201*h* if the pressure adjustment chamber 201*i* is formed by the elastic member 201*h* as in the case of the present embodiment. Also, besides the use of the elastic member 201*h*, it may be possible to combine a plastic sheet and a spring for the structure thereof. The volume of the pressure adjustment chamber 201*i* is set depending on the environmental temperature at which the recording head 201 is used, and the volume of the subtank 201*b* or the like as well, but for the present embodiment, it is set at approximately 0.5 ml.

If there is no provision of any pressure adjustment chamber 201*i*, the pressure in the sub-tank 201*b* directly receives the resistance that may be caused by the pressure loss when ink passes the main tank 204, the ink supply unit 205, and the ink supply tube 206. Therefore, in the case of the so-called high-duty that requires ink discharges at higher rate, such as discharging ink from all the nozzles 201*g*, the ink supply to the recording head 201 tends to become short against such an amount of ink to be discharged, hence raising the negative pressure abruptly. If the negative pressure of the nozzle 201*g* exceeds the aforesaid limited value of approximately −2.0 kPa, the discharges become unstable to ensue in the unfavorable condition of the image formation.

For the serial type recording apparatus of the present embodiment, when the carriage 202 (see FIG. 1) returns, the ink discharge is conditioned to be at rest even if the image formation is of the high-duty. The pressure adjustment chamber 201*i* performs a capacitor-like function such as to make the increase of negative pressure easier in the sub-tank 201*b* by reducing the volume thereof during ink discharge, and to restor it when the carriage returns.

Now, for example, ink supplied against ink discharged is considered to be $\Delta V=0.05$ ml short on assumption that the changing ratio of the negative pressure against the reduction of the volume of the pressure adjustment chamber 201*i* is K=−1 kPa/ml, and the volume of the sub-tank 201*b* is $V_s$=2 ml. In this case, if there is no pressure adjustment chamber 201*i*, the changes of the negative pressure in the sub-tank 201*b* become $\Delta P=V_s/(V_s+\Delta V)-1=-2.3$ kPa by the principle of "PV=constant". As a result, the negative pressure exceeds the aforesaid limited value to make the discharge instable. In contrast, if the pressure adjustment chamber 201*i* exists, the ΔP becomes equal to K×ΔV=−51 Pa, hence suppressing the increase of the negative pressure to make the discharge stable.

As described above, the stabilization of ink discharges are attempted by the provision of the pressure adjustment chamber 201*i*, while suppressing the influence of the pressure loss in the ink supply passage from the main tank 204 to the recording head 201. As a result, it becomes possible to use the ink supply tube 206 of a smaller diameter, which should follow the movement of the carriage 202, thus contributing to the reduction of load when the carriage 202 moves.

Next, with reference to FIGS. 2, 3 and 4, the description will be made of the ink supply unit 205 and main tank 204 that form the ink supply mechanism.

As shown in FIG. 2, the main tank 204 is structured to be attachable to and detachable from the supply unit 205. On the one side thereof, there are provided an ink supply port that can be closed with a rubber plug 204*b*, and an air inlet port closed with a rubber plug 204*c*. The main tank 204 is an airtight container by itself. Ink 209 is directly contained in the main tank 204. The ink supply port and the air inlet port of the main tank 204 are provided for the side face which correspond to the bottom face of the ink tank in the posture of being mounted.

On the other hand, as shown in FIG. 2, the ink supply unit 205 is provided with an ink supply needle 205*a* for drawing ink 209 from the main tank 204, and an air inducing needle 205*b* for inducing the air outside into the main tank 204. Both the ink supply needle 205*a* and the air inducing needle 205*b* are conductively hollow, and the needle tips are arranged upward in the setting state of the ink jet recording apparatus, corresponding to the positions of the ink supply port and air inducing port of the main tank 204. It is arranged that when the main tank 204 is installed as if dropped down from above to bottom of the ink supply unit 205, the ink supply needle 205*a* and the air inducing needle 205*b* penetrate the rubber plugs 204*b* and 204*c*, respectively, and enter the interior of the main tank 204.

Here, the flow path on the ink supply needle 205*a* side and the flow path on the air inducing needle 205*b* side are structured completely as each independent system. There is no structure that enables both the flow path on the ink supply needle 205*a* side and the flow path on the air inducing needle 205*b* side to be communicated with each other. However, these independent flow paths on the ink supply needle 205*a* side and air inducing needle 205*b* side are made one communicative flow path when the main tank 204 is installed on the ink supply unit 205. The structure is arranged so that the flow paths on the ink supply needle 205*a* side and the air inducing needle 205*b* side are separated as independent flow paths when the main tank 204 is not installed. With the flow paths thus structured, one flow path, which is closed between the air inducing port and the ink supply path, does not allow the air to enter on the way of the path even in the state of the ink jet apparatus being moved or being positioned aslant, thus eliminating ink leakage. Also, irrespective of the use environment and arrangement condition of the ink jet apparatus, there is no possibility that ink flows unexpectedly in the ink flow path from the air communication port to the ink supply path.

The ink supply needle 205*a* is connected with the ink supply tube 206 through the liquid flow path 205*c*, the cutting off valve 210, and the flow path 205*d*. The air inducing needle 205*b* is communicated with the air outside by way of the flow path 205*e*, the buffer chamber 205*f*, and the atmospheric communication port 205*g*. Both the liquid path 205*c*, which is positioned at the lowest height of the passage from the ink supply needle 205*a* to the ink supply tube 206, and the liquid path 205*e*, which is positioned at the lowest height of the passage from the air inducing needle 205*b* to the atmospheric communication portio 205*g*, are on the same height. The present embodiment uses the ink supply needle 205*a* and the air inducing needle 205*b* each having the large inner diameter of 1.6 mm, and the needle hole of 1.0 to 1.5 mm diameter.

Also, in order to prevent ink leakage from the atmospheric communication port 205*g*, the buffer chamber 205*f* is arranged to communicate with the atmospheric communication port 205*g* through the liquid path 205*j* that passes the position higher than the upper opening 205*i* of the air inducing needle 205*b*. For example, even if the main tank 204 having ink contained therein is installed erroneously without the installation of the recording head 201, and the cutting off valve 210 is open, the air is induced into the main tank 204 by means of the ink supply needle 205*a*. In this case, the leading end of the ink supply needle 205*a* has the atmospheric pressure, and ink begins to flow to a lower part and leaks if the atmospheric communication port 205*g* is positioned lower than the upper opening 205*i*. To avoid such problem as this, the buffer chamber 205*f* is communicated with the atmospheric communication port 205*g* through the liquid path 205*j* that passes the position higher than the upper opening 205*i*. In this respect, the same effect is obtainable with the structure in which the atmospheric communication port 205*g* itself is positioned higher than the upper opening 205*i* as shown in FIGS. 3A, 3B, 3C and 3D and in FIG. 4, for example.

The cutting off valve 210 is provided with a diaphragm 210*a* formed by the rubber material that conducts the opening and closing between the two liquid paths 205*c* and 205*d* are conducted with the disposition of the diaphragm 210*a*. On the upper face of the diaphragm 210*a*, a cylindrical spring holder 210*b* is fixed to contain a pressure spring 210*c* therein. With the pressure spring 210*c*, the diaphragm 210*a* is squashed to cut off between the liquid paths 205*c* and 205*d*. The spring holder 210*b* is provided with the flange which the lever 210*d* engages by the operation of the link 207*e* of the recovery unit 207 to be described later. When the lever 210*d* operates to hold up the spring holder 210*b* against the spring force of the pressure spring 210*c*, the liquid paths 205*c* and 205*d* are communicated. The cutting off valve 210 is open when the recording head 201 discharges ink, and closed when the recording head is on standby or at rest. During the ink filling operation which will be described later, the cutting off valve is open or closed in synchronism with the operation timing of the recovery unit 207.

The ink supply unit 205 structured as described above is provided per main tank 204, that is, per ink color, with the exception of the lever 210*d*. The use of the lever 210*d* is shared by all the colors to open or close the cutting off valve 210 simultaneously with respect to all the colors.

With the structure thus arranged, ink is supplied from the main tank 204 to the recording head 201 all the time through the ink supply unit 205 and the ink supply tube 206 by means of the negative pressure resulting from the consumption of ink in the recording head 201. At this juncture, the same amount of air as that of ink supplied from the main tank 204 is induced from the atmospheric communication port 205*g* into the main tank 204 by way of the buffer chamber 205*f* and the air inducing needle 205*b*.

The buffer chamber 205*f* is a space to aim at provisionally retaining the ink that has flown out form the main tank 204 due to the expansion of air in the main tank 204, and the lower end of the air inducing needle 205*b* is positioned at the bottom of the buffer chamber 205*f*. In other words, the buffer chamber 205*f* is structured to be a space expanded upward from the lower end of the air inducing needle 205*b* in the gravitational direction. If the air in the main tank 204 is expanded due to the increased environmental temperature or the like while the ink jet recording apparatus is on standby or at rest, ink in the main tank 204 flows out to the buffer chamber 205*f* from the air inducing needle 205*b* through the liquid path 205*e*, because the cutting off valve 210 is closed. On the contrary, if the air in the main tank 204 is contracted due to the decreased temperature or the like, the ink that has flown out into the buffer chamber 205*f* returns to the main tank 204 through the lower end of the air inducing needle 205*b* positioned on the bottom of the buffer chamber 205*f*. Also, when ink is discharged from the recording head 201 in a state of ink existing in the buffer chamber 205*f*, the ink that exists in the buffer chamber 205*f* returns to the main tank 204 at first. Then, after ink no longer exists in the buffer chamber 205*f*, the air is induced into the main tank 204.

The opening of the air inducing needle 205*b* to the buffer chamber 205*f* is formed to be in a diameter good enough to provide the meniscus of ink.

The volume $V_b$ of the buffer chamber 205*f* should be set to satisfy the use environment of the product. Here, given the lower limit of the use environmental temperature of an apparatus as $T_1$ K, and the upper limit, as $T_2$ K, and the volume of the ink tank as $V_t$, it becomes possible to prevent ink leakage if the $V_b > V_t \times (T_2 - T_1)/T_2$. Now, for example, assuming that a product is within the use environmental temperature of 5° C. (278 K) to 35° C. (308 K), the $V_b$ to be set for the buffer chamber=100×(308−278)/308=9.7 ml or more where the volume $V_t$ of the main tank 204=100 ml.

In this respect, with reference to FIGS. 3A, 3B, 3C and 3D, the description will be made of the fundamental water head of the main tank 204, and the behavior of the air and ink in the liquid path of the ink supply unit 205 when the air is induced into the main tank 204.

Figure 3A:
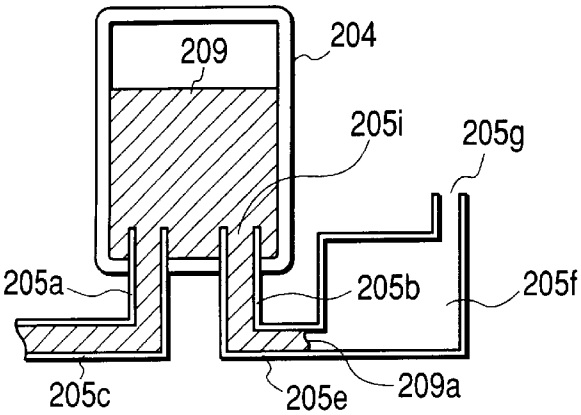
FIGS. 3A, 3B, 3C and 3D are views that illustrate the behavior of air and ink in the liquid paths of an ink supply unit when the air is inducted into the main tank.

FIG. 3A shows the usual state in which ink can be supplied from the main tank 204 to the recording head 201 (see FIG. 2). In this state, the interior of the main tank 204 is airtight with the exception of the buffer chamber 205*f*. The interior of the main tank 205 is kept in negative pressure. The tip 209*a* of ink remains in the midway of the liquid path 205*e*. The pressure of the tip 209*a* of ink is the atmospheric pressure (=101.3 kPa), because it is in contact with the atmosphere. The liquid path 205*c* where the tip 209*a* of ink is positioned, and the liquid path 205*e* with which the ink supply tube 206 (see FIG. 2) communicates are at the same height, and only ink between both liquid paths 205*c* and 205*e* is allowed to be communicated. Therefore, the pressure in the liquid path 205*c* is also the atmospheric pressure. This is determined by the relationship between the tip 209*a* of ink and the height of the liquid path 205*c*, and it is not affected by the amount of ink 209 in the main tank 204.

Figure 3B:
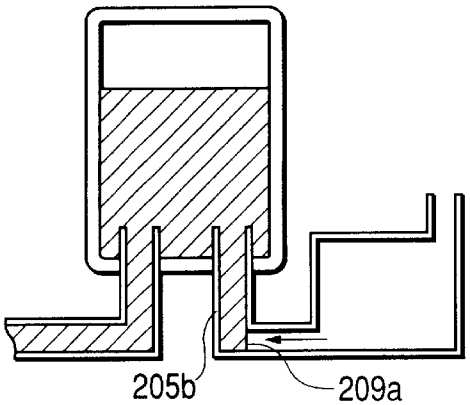
Figure 3C:
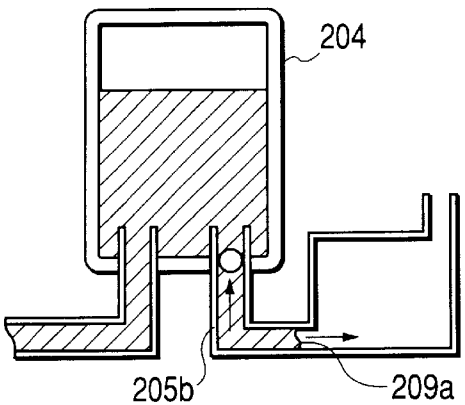

When ink in the main tank 204 is consumed, the tip 209*a* of ink gradually moves in the direction toward the air inducing needle 205*b* as shown in FIG. 3B, and when it reaches the point immediately under the air inducing needle 205*b*, it becomes a bubble as shown in FIG. 3C and floats up in the air inducing needle 205*b* to be induced into the main tank 204. Then, in place thereof, ink in the main tank 204 enters the air inducing needle 205*b*, and the tip 209*a* of ink returns to the original state as shown in FIG. 3A.

Figure 3D:
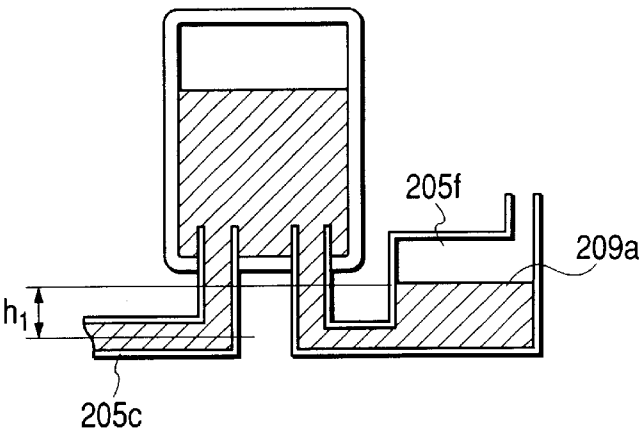

FIG. 3D shows the state where ink is retained in the buffer chamber 205*f*. In this case, the tip 209*a* of ink is positioned higher than the liquid path 205*c* only by h1 mm in the middle of the height direction of the buffer chamber 205*f*, and the pressure in the liquid path 205*c* becomes −9.8 h1 Pa.

Figure 4:
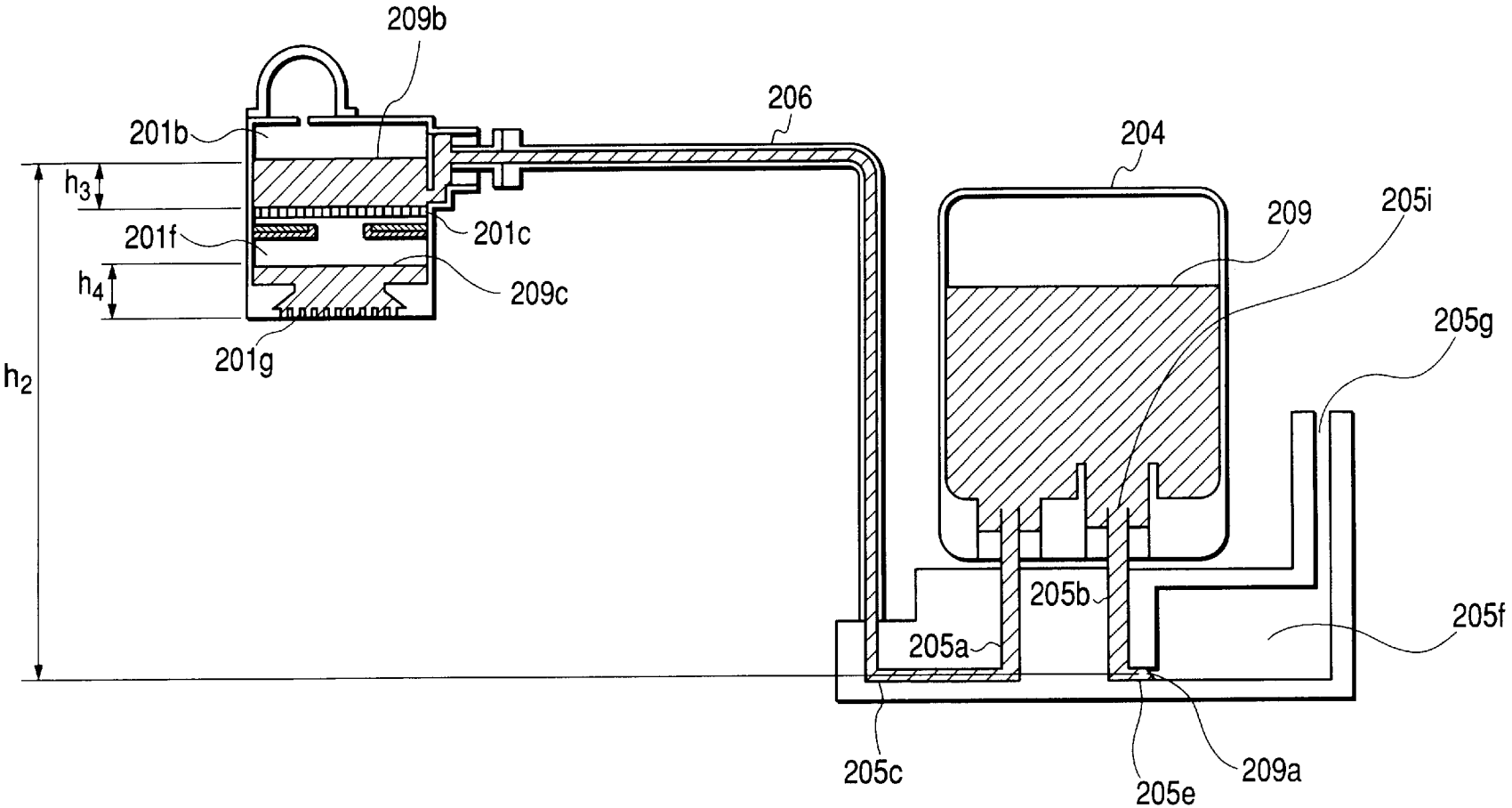
FIG. 4 is a view that illustrates the pressure exerted on the nozzle by means of water head difference.
Figure 5:
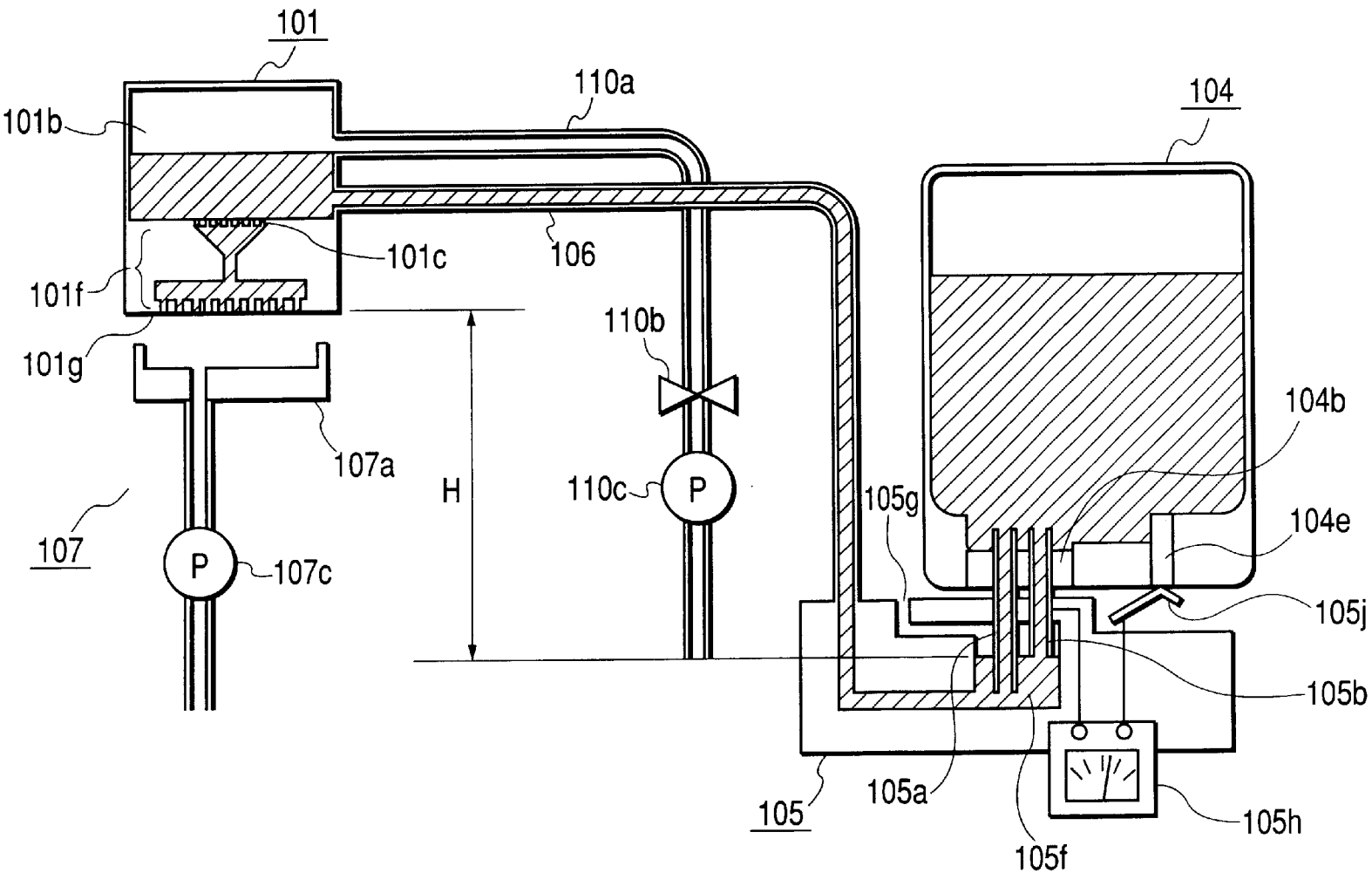
FIG. 5 is a view that illustrates the one structural example of the ink supply system of the conventional ink jet recording apparatus.

As described above, in accordance with the present embodiment, the pressure exerted by the water head differential of the nozzle 201*g* (see FIG. 2) indicates the negative pressure $P_n$ at the lower end of the nozzle 201*g* is $P_n$ −9.8(h2-h3-h4) Pa in the usual state where, as shown in FIG. 4, the height from the flow path 205*c* to the upper face 209*b* of ink in the sub-tank 201*b* is h2 mm; the height from the filter 201*c* to the upper face 209*b* of ink in the sub-tank 201*b* is h3 mm; and the height from the lower end of nozzle 201*g* to the upper face 209*c* of ink in the liquid chamber 201*f* is h4 mm, and it indicates $P_n$ −9.8(h2-h1-h3-h4) Pa in the state of ink being retained in the buffer chamber 205*f*. The value $P_n$ is set to be within the range of the aforesaid range of negative pressure of (−0.4 kPa to −2.0 kPa).

Now, again, referring to FIG. 2, a circuit 205*h* is connected with the ink supply needle 205*a* and the air inducing needle 205*b* to measure the electric resistance of ink, and the presence and absence of ink in the main tank 204 is made detectable. The circuit 205*h* detects the electrical closing if there is ink residing in the main tank 204, because electric current runs through the circuit 205*h* with the intervention of ink in the main tank 204, and it detects the electrical open if ink does not exist or the main tank 204 is not installed. Since the detecting current is extremely small, it is important to insulate the ink supply needle 205*a* and the air inducing needle 205*b* as well. In accordance with the present embodiment, the passage from the ink supply needle 205*a* to the recording head 201, and the passage from the air inducing needle 205*b* to the atmospheric communication port 205*g* are made completely independent, and utmost care is taken to make it possible to measure the electric resistance of ink only in the main tank 204.

Next, a recovery unit 207 will be described.

The recovery unit 207 operates the suction of ink and air from the nozzle 201*g*, as well as the opening and closing of the cut off valve 210, which comprises a suction cap 207*a* for capping the ink discharge surface (where the nozzle 201*g* is open) of the recording head 201 and a link 207*e* that operates the lever 210*d* for the cutting off plane 210.

The suction cap 207*a* is formed by the elastic member, at least the portion thereof, which is in contact with ink discharge surface, being rubber or the like, and installed movably between the position where it airtightly closes the ink discharge surface and the position where it retracts from the recording head 201. To the suction cap 207*a*, the tube having a suction pump 207*c* of tube pump type arranged on the middle portion thereof is connected to make it possible to perform suction continuously by driving the suction pump 207*c* by use of a pump motor 207*d*. It is also made possible to change the suction amount corresponding to the rotational amount of the pump motor 207*d*. For the present embodiment, a suction pump capable of reducing pressure to 40.5 kPa is used as the pump 207*c*.

The cam 207*b* operates the suction cap 207*a*. By use of a cam control motor 207*g*, the link 207*e* operates in synchronism with the movement of the cam 207*f*. The timing at which the cam 207*b* is in contact with the suction cap 201*g* at the positions a to c, respectively, is identical with the timing at which the cam 207*f* is in contact with the link 207*e* at the positions a to c, respectively. At the position a, the cam 207*b* enables the suction cap 201*g* to part from the ink discharge surface of the recording head 201, and the cam 207*f* pushes the link 207*e* to raise the lever 210*d* to open the cut off valve 210. At the position b, the cam 207*b* enables the suction cap 201*g* to be closely in contact with the ink discharge surface, and the cam 207*f* draws back the link 207*e* to close the cut off valve. At the position c, the cam 207*b* enables the suction cap 207*a* to be airtightly in contact with the ink discharge surface, and the cam 207*f* pushes the link 207*e* to open the cut off valve 210.

In the recording operation, the cams 207*b* and 207*f* are set at the position a so that ink is discharged from the nozzle 201*g*, and the ink supply from the main tank 204 to the recording head 201 is made possible. When recording is not in operation, which includes the state of being on standby and at rest, the cams 207*b* and 207*f* are set at the position b to prevent the nozzle 201*g* from being dried, while preventing ink from flowing out from the recording head 201 (particularly when the apparatus itself should be carried for another location, there may a case where the apparatus is inclined to allow ink to flow out). The position c for the cams 207*b* and 207*f* is used for ink filling to the recording head 201 as given below.

Now, the description has been made of the ink supply path from the main tank 204 to the recording head 201. With a structure as shown in FIG. 2, however, it is inevitable that the air is accumulated in the recording head 201 in a long run.

In the sub-tank 201*b*, there are accumulated the air that has permeated the ink supply tube 206 and the elastic member 201*h* to enter it, and the air that has been dissolved to reside in ink. As to the air that permeates the ink supply tube 206 and the elastic member 201*h*, it may be possible to use a structural material having a high gas barrier capability for them, but the material having a high gas barrier capability is too expensive to be used easily for the commercial equipment manufactured on a large scale with the cost aspect in view. For the present embodiment, the low-cost and highly flexible polyethylene tube, which is easy to handle, is used for the ink supply tube 206, and butyl rubber is used for the elastic member 201*h*.

Meanwhile, the air is gradually accumulated in the liquid chamber 201*f* because the bubble, which has been generated in ink by film boiling for discharging ink from the nozzle 201*g*, is split to return to the liquid chamber 201*f* or because fine bubbles dissolved to reside in ink are gathered to become a large bubble as the temperature of ink is increased in the nozzle 201*g*.

In accordance with the experiments conducted by the inventors hereof, the structure of the present embodiments allows the amount of air accumulation in the sub-tank 201*b* is approximately 1 ml per month, and the amount of air accumulation in the liquid chamber 201*f* is approximately 0.5 ml per month.

In the amount of air accumulation is large in the sub-tank 201*b* and the liquid chamber 201*f*, the amount of ink retained in each of the sub-tank 201*b* and the liquid chamber 201*f* is reduced eventually. As a result, in the sub-tank 201*b*, if ink becomes short, the filter 201*c* is exposed to the air to reduced the effective area of the filter 201*c*. Then, the pressure loss of the filter 201*c* increases to make it impossible to supply ink to the liquid chamber 201*f* in the worst case. On the other hand, if the upper end of the nozzle 201*g* is exposed to the air in the liquid chamber 201*f*, the ink supply to the nozzle 201*g* is disabled. Therefore, there is a possibility that a critical problem is encountered unless more than a specific amount of ink is retained both in the sub-tank 201*b* and the liquid chamber 201*f*.

Thus, an appropriate amount of ink is filled each in the sub-tank 201*b* and the liquid chamber 201*f* per specific period in order to maintain the ink discharge function for a long time even without using an expensive material having gas-barrier capability. In the case of the present embodiment, for example, it should be good enough if only ink is filled in the sub-tank 201*b* and the liquid chamber 201*f* per month in an amount equivalent to the amount of air accumulation per month plus variation at the time of respective ink filling.

The ink filling to the sub-tank 201*b* and the liquid chamber 201*f* is conducted by the utilization of suction operation of the recovery unit 207. In other words, the suction pump 207*c* is driven in a state of the ink discharge surface of the recording head 201 being airtightly closed by use of the suction cap 201*a*. Then, ink in the recording head 201 is sucked through the nozzle 201*g*. However, if only ink is sucked from the nozzle 201*g*, substantially the same amount of ink as the ink sucked from the nozzle 201*g* is allowed to flow from the sub-tank 201*b* to the liquid chamber 201*f*. Likewise, substantially the same amount of ink as the ink that has flown out from the sub-tank 201*b* is allowed to flow out from the main tank 204 into the sub-tank 201*b*. Here, the situation remains almost unchanged from the one before suction.

In accordance with the present embodiment, therefore, the cut off valve 210 is utilized for the reduction of the pressure each in the sub-tank 201*b* and the liquid chamber 201*f* to a designated pressure in order to fill an appropriate amount of ink each in the sub-tank 201*b* and the liquid chamber 201*f*, which are partitioned by use of the filter 201*c*. In this manner, the volume setting is conducted for both sub-tank 201*b* and the liquid chamber 201*f*.

Hereunder, the description will be made of the ink filling operation and the volume setting with respect to the sub-tank 201*b* and the liquid chamber 201*f*.

To operate ink filling, the carriage 202 (see FIG. 1) is allowed to move to the position where the recording head 201 faces the suction cap 207*a* at first, and then, the cams 207*b* and 207*f* are driven by the cam control motor 207*g* of the recovery unit 207 to rotate them so that the position b is in contact with the suction cap 107*a* and the link 207*e*, respectively. In this way, the ink discharge surface of the recording head 201 is airtightly closed by the suction cap 207*a*, and the cut off valve 210 is in a state of closing the ink path from the min tank 204 to the recording head 201.

In this state, the pump motor 207*d* is driven to conduct suction from the suction cap 207*a* by use of the suction pump 207*c*. With this suction, the remaining ink and air in the recording head 201 are sucked through the nozzle 201*g*, and the inner pressure of the recording head 201 is reduced. When the suction amount of the suction pump 207*c* reaches a designated amount, the suction pump 207*c* is suspended, and the cam control motor 207*g* is driven to rotate the cams 207*b* and 207*f* so that the position c is in contact with the suction cap 207*a* and the link 207*e*, respectively. In this way, the cut off valve 210 is open while the suction cap 207*a* remains to airtightly close the ink discharge surface. The suction amount of the suction pump 207*c* is the one that makes the inner pressure of the recording head 201 a specific pressure needed to fill ink in the sub-tank 201*b* and the liquid chamber 201*f* in an appropriate amount, respectively. This can be obtained by calculation, experiment, or the like.

When the inner pressure of the recording head 201 is reduced, ink flows into the recording head 201 through the ink supply tube 206, and the sub-tank 201*b* and the liquid chamber 201*f* are filled with ink, respectively. The amount of ink to be filled is the volume needed for the decompressed sub-tank 201*b* and liquid chamber 201*f* to return to substantially having the atmospheric pressure, respectively, which is determined by the respective volume and pressure of the sub-tank 201*b* and liquid chamber 201*f*.

The ink filling to the sub-tank 201*b* and the liquid chamber 201*f* is complete in approximately 1 second after the cut off valve 210 has been open. With the completion of the ink filling, the cam control motor 207*g* is driven to rotate the cams 207*b* and 207*f* so that the position b is in contact with the suction cap 207*a* and the link 207*e*, respectively. In this way, the suction cap 207*a* is allowed to part from the recording head 201. Then, the suction pump 207*c* is again driven to suck the remaining ink in the suction cap 207*a*. Also, in this state, the cut off valve 210 is in the state of being open to make it possible to form characters, images, or the like on a recording sheet S (see FIG. 1) by discharging ink from the nozzle 201*g*. Here, if the operation is on standby or at rest, the cam control motor 207*g* is again driven to rotate the cams 207*b* and 207*f* so that the position b is in contact with the suction cap 207*a* and the link 207*e*, respectively. Thus, the ink discharge surface of the recording head 201 is airtightly covered by the suction cap 201*a*, and the cut off valve 210 is closed.

If the amount of ink in the sub-tank 201*b* and the liquid chamber 201*f* does not become short for a long time, there is no need for any frequent suction operation to be conducted by use of the recovery unit 207, and the occasion also becomes less for any wasteful use of ink. Further, even if ink should be filled both in the sub-tank 201*b* and the liquid chamber 201*f*, only a one-time filling operation will suffice so as to save the consumption of ink.

Here, the volume of the sub-tank 201*b* is given as V1; the amount of ink to be filled in the sub-tank 201*b* as S1; and the inner pressure of the sub-tank 201*b* as P1 (relative value to the atmospheric pressure). Now, from the principle of "PV=constant", it becomes possible to fill ink in the sub-tank 201*b* in an appropriate amount by the execution of the filling operation so that the relations between them can be set at V1=S1/P1. Likewise, the volume of the liquid chamber 201*f* is given as V2; the amount of ink to be filled in the liquid chamber 201*f* as S2; and the inner pressure of the liquid chamber 201*f* as P2 (relative value to the atmospheric pressure). Now, if the relations therebetween are set to be V2=S2/P2, it becomes possible to fill ink in the liquid chamber 201*f* in an appropriate amount by the execution of the filling operation.

Also, the filter 201*c* that partitions the sub-tank 201*b* and the liquid chamber 201*f* is formed with a fine mesh to make it difficult for the air to flow through in the state of meniscus being formed as described earlier. Here, the pressure needed for the air to pass the filter 201*c* having the meniscus formed therefor is given as Pm. When suction is made for the nozzle 201*g* by use of the recovery unit 207, the inner pressure P2 of the liquid chamber 201*f* is made lower than the inner pressure P1 of the sub-tank 201*b* only by the portion Pm described above in order to enable the air in the sub-tank 201*b* to pass by way of the filter 201*c*. Thus, with this relationship being used for setting the volume of the sub-tank 201*b* and the liquid chamber 201*f* as well, it becomes easier to determine the conditions of filling operation.

Here, the description will be made of the specific example of the aforesaid filling operation and volume setting.

The ink filling is executed once a month. The amount of air accumulated during a month is assumed to be 1 ml for the sub-tank 201*b*, and 0.5 ml for the liquid chamber 201*f*. Also, the amount of ink needed not to allow the filter 201*c* to be exposed to the air in the sub-tank 201*b* is assumed to be 0.5 ml, and the amount of ink needed not to allow the nozzle 201*g* to be protruded to the air in the liquid chamber 201*f* is assumed to be 0.5 ml. The variation of the ink filling amount is assumed to be 0.2 ml both for the sub-tank 201*b* and the liquid chamber 201*f*. These numerical values are obtained by experiments. From the above, the amount of ink to be filled per filling is the total of these values, and set at 1.7 ml for the sub-tank 201*b* and 1.2 ml for the liquid chamber 201*f*.

The range of pressure reduction in the recording head 201 is set at the value that does not exceed the capability of the recovery unit 207. For the present embodiment, the capability limit of the suction pump 207*c* is −60.8 kPa, and the suction amount of the suction pump 207*c* is obtained by experiments so that the inner pressure of the suction cap 207*a* becomes −50.6 kPa providing some room, which is controlled as the rotational amount of the pump motor 207*b*.

Here, owing to the presence of meniscus of the nozzle 201*g*, the pressure needed to enable the air to pass is −5.1 kPa (experimental value). Therefore, difference occurs between the inner pressure of the suction cap 207*a* and the inner pressure of the liquid chamber 201*f* by the portion equivalent to the resistance of the nozzle 201*g*. Thus, the inner pressure of the liquid chamber 201*f* becomes higher than that of the cap 207*a* by 5.1 kPa. Likewise, owing to the presence of the meniscus of the filter 201*c*, the pressure needed to enable the air to pass is −10.1 kPa (experimental value). Therefore, difference occurs between the inner pressure of the liquid chamber 201*f* and the inner pressure of the sub-tank 201*b* by the portion equivalent to the resistance of the filter 201*c*. Thus, the inner pressure of the sub-tank 201*b* becomes higher than that of the liquid chamber 201*f* by 10.1 kPa. Therefore, if the inner pressure of the suction cap 207*a* is set at −50.7 kPa, the inner pressure of the liquid chamber 201*f* becomes −45.6 kPa and the inner pressure of the sub-tank 201*b* becomes −35.5 kPa.

In order to fill ink of 1.7 ml in the sub-tank 201*b*, the volume V1 of the sub-tank 201*b* is set so as to make the inner pressure thereof to be −35.5 kPa when ink of 1.7 ml is sucked form the sub-tank 201*b* whose inner pressure is almost 101.3 kPa at that time. In other words, the setting is V1=1.7/0.35=4.85 ml. Likewise, for the volume V2 of the liquid chamber 201*f*, the setting is V2=1.2/0.45=2.67 ml.

After the inner pressure of the recording head 201 is reduced on the aforesaid conditions, the cut off valve 210 is open to enable ink to flow into the recording head 201 the inner pressure of which has been made negative. To described more precisely, ink flows into the sub-tank 201*b* at first, and then, the air that has expanded to the V1 due to the reduced pressure is restored almost to the atmospheric pressure. Then, given the volume of the air in the sub-tank 201*b* as $V1_a$, the $V1_a = V1 \times (1-0.35) = 3.15$ ml, and when ink of $V1 - V1_a = 1.7$ ml is filled in the sub-tank 201*b*, it settles down. Likewise, ink flows into the liquid chamber 201*f* form the sub-tank 201*b*, and the air that has expanded to the V2 due to the reduced pressure is restored almost to the atmospheric pressure. Then, given the volume of the air in the liquid chamber 201*f* as $V2_a$, the $V2_a=V2\times(1-0.45)=1.47$ ml, and when ink of $V2-V2_a=1.2$ ml is filled in the liquid chamber 201*f*, it settles down.

As described above, if each of the volumes and pressures to be reduced is set for the sub-tank 201*b* and the liquid chamber 201*f*, it becomes possible to fill in the sub-tank 201*b* and the liquid chamber 201*f* partitioned by the filter 201*c* each appropriate amount of ink by the one-time filling operation, and perform normal operation for a long time without suction operation even under the circumstance that the air is accumulated in the recording head 201.

Also, as described earlier, an air layer exists between the filter 201*c* and the upper face of ink in the liquid chamber 201*f*. However, the amount of this air layer can be set arbitrarily by means of the sucking pressure of the suction operation of the recovery unit 207. In other words, this air layer is the one that can be controlled.

This arrangement makes it possible to improve reliability significantly against the discharge defects that may be brought about conventionally by the bubble generated between the filter and nozzle. In other words, the problem encountered in the conventional art that the effective area of the filter is caused to change (to be reduced) due to the presence of uncontrollable bubble under the filter is now simply taken into consideration in the stage of designing, because according to the present embodiment the filter 201*c* is in contact with the air layer at the portion (the opening portion at 201*d* in FIG. 2), which is controlled from the beginning so that the effective area of the filter 201*c* is not allowed to change. Also, to deal with the problem that bubble may clog the flow path between filter and nozzle, the sectional area of the liquid chamber 201*f* is formed to be large enough against the diameter of the bubble that may be allowed to reside in the liquid chamber 201*f* to eliminate any possibility that the bubble in the liquid chamber 201*f* blocks the flow of ink. Further, regarding the problem that the bubble in the liquid chamber may enter the nozzle or clog the communication passage between the liquid chamber and nozzle, there is no possibility that it enters the nozzle 201*g*, because the sectional area of the liquid chamber 201*f* is large enough as described above so that the bubble generated in the liquid chamber 201*f* ascends in ink in the liquid chamber 201*f* by means of its floating power to be combined with the air layer. Furthermore, this air layer is controllable as described above, and there is no possibility that the effective area of the filter 201*c* does not change even if the bubble generated in the liquid chamber 201*f* is combined with the air layer.

In other words, with the liquid chamber 201*f* structured to be partitioned from the sub-tank 201*b* by use of the filter 201*c*, it becomes possible to significantly enhance reliability against the discharge defects that may be caused by the generation of bubble in the liquid chamber 201*f*, and the movement of the bubble thus generated.

As described above, according to the ink supply mechanism of the present invention, the first and second hollow needles are inserted into each connector of ink tank serving as the main tank for communication to make them one flow path airtightly closed to the atmosphere between the atmospheric communication port and the ink supply path through the ink tank. In other words, with the arrangement to make the passage from the atmospheric communication port to the ink supply path one closed flow path, it becomes possible to eliminate the flow-in of air on the midway of the flow path, as well as the ink leakage, while blocking the movement of ink in the flow path. As a result, it is possible to prevent any ink leakage from the atmospheric communication port that may be caused due to the inclination of the main body or the like.

Also, with the measurement of the value of electric resistance between the first and second hollow needles formed by conductive material, there is no possibility to detect any resistance of ink residing outside the ink tank. Consequently, not only the presence and absence of ink in the ink tank can be detected correctly, but also, whether or not the ink tank is installed can be detected, hence making it possible to grasp the recordable conditions exactly.

What is claimed is:

1. An ink supply mechanism for supplying ink a recording head, comprising:

an ink tank attachable and detachable, having ink retained therein and a connecting portion;

a first hollow needle inserted into said connecting portion of the ink tank for leading out said ink;

a second hollow needle inserted into said connecting portion of said ink tank to make said ink tank in an atmospheric communication state;

an ink supply path continuously provided to said first hollow needle and communicated with the recording head for supplying ink to the recording head; and an atmospheric communication path continuously provided to said second hollow needle, communicated with an atmosphere, and constituting a buffer area, wherein said ink supply path and said atmospheric communication path are independently arranged, said ink tank is provided between said atmospheric communication path and said ink supply path by mounting said ink tank so that a single path is arranged from said atmospheric communication path to said ink supply path.

2. An ink supply mechanism according to claim 1, wherein said first hollow needle and second hollow needle are formed by conductive material, and a circuit is provided to measure the value of electric resistance between said first and second hollow needles.

3. An ink supply mechanism according to claim 1, further comprising an atomospheric communication chamber communicated with said second hollow needle and an atmospheric communication port communicated with said atmospheric communication chamber; wherein said atmospheric communication chamber is a space expanded from the lower end of said second hollow needle upward, and the atmospheric communication port provided for said atmospheric communication chamber is arranged at a position higher than an opening of said second hollow needle on an insertion side thereof into said connecting portion for communication.

4. An ink supply mechanism according to claim 1, wherein the atmospheric communication path connects the second hollow needle to an atmospheric communication port; and wherein part of the atmospheric communication path between said atmospheric communication port and said second hollow needle is positioned to be higher than the opening of said second hollow needle on the insertion side thereof into said connecting portion for communication.

5. An ink supply mechanism according to claim 1, further comprising an atomospheric communication chamber communicated with said second hollow needle, wherein the volume of said atmospheric communication chamber satisfies $$Va>Vt\times(T_2-T_1)/T_2$$

where $T_1$: the lower limit temperature of use environmental temperature $T_2$: the upper limit temperature of use environmental temperature Va: the volume of said atmospheric communication chamber Vt: the volume of said ink tank.

6. An ink jet recording apparatus provided with conveying means for conveying a recording medium to perform recording by discharging ink from a recording head to said recording medium, comprising:

an ink supply mechanism according to claim 1.

* * * * *

UNITED STATES PATENT AND TRADEMARK OFFICE

CERTIFICATE OF CORRECTION

PATENT NO. : 6,702,433 B2
DATED : March 9, 2004
INVENTOR(S) : Takeshi Kono

It is certified that error appears in the above-identified patent and that said Letters Patent is hereby corrected as shown below:

Title page,
Item [56], References Cited, FOREIGN PATENT DOCUMENTS, "JP 405096744" should read -- JP 5-096744 --.

Column 2,
Line 58, "unusual" should read -- an unusual --.

Column 6,
Line 61, "filer" should read -- filter --.

Column 8,
Line 23, "filer" should read -- filter --.

Column 10,
Line 13, "portio" should read -- portion --.

Column 11,
Line 8, "form" should read -- from --.

Column 13,
Line 25, "may" should read -- may arise --;
Line 57, "allows" should read -- allows that --;
Line 61, "In" should read -- If --; and
Line 66, "reduced" should read -- reduce --.

Column 14,
Line 54, "min" should read -- main --.

Column 16,
Line 49, "form" should read -- from --;
Line 56, "open" should read -- opened --; and
Line 64, "form" should read -- from --.

UNITED STATES PATENT AND TRADEMARK OFFICE

CERTIFICATE OF CORRECTION

PATENT NO. : 6,702,433 B2
DATED : March 9, 2004
INVENTOR(S) : Takeshi Kono

It is certified that error appears in the above-identified patent and that said Letters Patent is hereby corrected as shown below:

Column 18,
Line 13, “in a” should read -- ink to a --; and
Lines 42 and 61, “atmospheric” should read -- atmospheric --.

Signed and Sealed this

Twenty-eighth Day of September, 2004

JON W. DUDAS
*Director of the United States Patent and Trademark Office*